US009453352B2

(12) United States Patent
Kasahara et al.

(10) Patent No.: US 9,453,352 B2
(45) **Date of Patent: *Sep. 27, 2016**

(54) REINFORCING BAR BINDING MACHINE

(71) Applicant: MAX CO., LTD., Tokyo (JP)

(72) Inventors: Akira Kasahara, Tokyo (JP); Atsushi Matsuoka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/640,910

(22) Filed: Mar. 6, 2015

(65) Prior Publication Data

US 2015/0176295 A1 Jun. 25, 2015

Related U.S. Application Data

(63) Continuation of application No. 11/994,261, filed as application No. PCT/JP2006/312918 on Jun. 28, 2006, now Pat. No. 9,004,114.

(30) Foreign Application Priority Data

Jul. 1, 2005 (JP) ..... P2005-194206

(51) Int. Cl.
*E04G 21/12* (2006.01)

(52) U.S. Cl.
CPC ..... *E04G 21/123* (2013.01); *E04G 21/122* (2013.01)

(58) Field of Classification Search
CPC ... E04G 21/122; E04G 21/123; B65B 13/02; B65B 13/187; B65B 13/027; B21F 15/04
See application file for complete search history.

(56) References Cited

U.S. PATENT DOCUMENTS 6,145,360 A 11/2000 Honsel et al.

FOREIGN PATENT DOCUMENTS

| | | |
|---|---|---|
| JP | 5-10208 | 2/1993 |
| JP | 5-330507 | 12/1993 |
| JP | 7-101408 | 4/1995 |
| JP | 8-50982 | 2/1996 |
| JP | 9-156608 | 6/1997 |
| JP | 2692495 B2 | 9/1997 |
| JP | 10-46821 | 2/1998 |
| JP | 11-320015 | 11/1999 |
| JP | 2001-38647 | 2/2001 |
| JP | 2001-157361 A | 6/2001 |
| JP | 2003-27746 | 1/2003 |
| JP | 2003-267307 A | 9/2003 |

*Primary Examiner* — Debra Sullivan
(74) *Attorney, Agent, or Firm* — Drinker Biddle & Reath LLP

(57) ABSTRACT

A reinforcing bar binding machine is provided with a device for detecting a power supply voltage during a binding wire twisting step subjected to the heaviest load and comparing the power supply voltage with a predetermined CPU operation voltage, and a control device for driving a motor in a reverse direction when the voltage has dropped below the predetermined CPU operation voltage. The power supply voltage during operation is monitored, and twisting operation is suspended before the voltage drops below the CPU operation voltage, whereby the binding wire twisting mechanism is returned to the initial position. Therefore, it is possible to prevent the binding wire twisting mechanism from being stopped while grasping the binding wire, when the CPU stops.

3 Claims, 3 Drawing Sheets

REINFORCING BAR BINDING MACHINE

This is a continuation application of copending application Ser. No. 11/994,261, having a 0371 date of Dec. 28, 2007, which is a national filing based on PCT International Application No. PCT/JP2006/312918 filed on Jun. 28, 2006. The copending application Ser. No. 11/994,261 is incorporated by reference herein in its entirety.

TECHNICAL FIELD

The present invention relates to a reinforcing bar binding machine, and more particularly, to the reinforcing bar binding machine in which improvement in stability of performance under low temperatures and a drop of voltage is achieved.

BACKGROUND ART

A reinforcing bar binding machine which is driven by a motor is provided with a binding wire feeding mechanism for feeding a binding wire to wind it around a reinforcing bar, a binding wire twisting mechanism for grasping and twisting the binding wire wound around the reinforcing bar thereby to strongly tighten the reinforcing bar, and a binding wire cutting mechanism for cutting off a back end of a loop of the binding wire from a following binding wire at the same time when twisting operation of the twisting mechanism starts. In the reinforcing bar binding machine, when an operator pulls a trigger lever, one cycle of operation which includes feeding, cutting and twisting the binding wire is carried out. Structure of this reinforcing bar binding machine is described in many documents, for example, in Patent Documents 1, 2, 3, and 4.

Operation sequence of the reinforcing bar binding machine is controlled by a CPU. When electric current has reached a certain preset value during a twisting step, the CPU judges finish of the twisting step and rotates the motor in a reverse direction to return the twisting mechanism to an initial position, whereby one cycle of the operation is completed.

Patent Document 1: JP-B2-2692495
Patent Document 2: JP-A-2001-038647
Patent Document 3: JP-A-2003-027746
Patent Document 4: JP-A-2003-267307

A battery driven tool, not confined to the reinforcing bar binding machine, has a problem that mechanical performance such as torque, rotation number and so on may be deteriorated due to deterioration of battery performance under low temperature environment. In the reinforcing bar binding machine, finish of the twisting step is judged by detecting an increase of an electric current value during the twisting step. However, because heavy load is applied in the twisting step for twisting a metallic wire, a power supply voltage remarkably drops, and when discharging performance of the battery is deteriorated under the low temperature environment, the power supply voltage instantaneously drops below an operation voltage of the CPU during the twisting step, and the machine sometimes stops during the twisting operation. In this case, the voltage of the battery is recovered by the stop of the operation whereby the CPU is reset, and when the motor is energized, the voltage drops again. By repeating the stop and reset of the CPU in this manner, one cycle of the operation becomes unable to be completed.

Binding strength of the reinforcing bar is proportional to the number of windings of the binding wire loop. In case where high binding strength is required such as in case of constructing a bridge or a road where the binding is conducted by increasing the number of windings of the binding wire to four windings, for example, twisting load is also increased. Therefore, there is such anxiety that stops of operation may frequently occur due to a drop of the voltage under low temperature environment.

DISCLOSURE OF THE INVENTION

One or more embodiments of the invention provide a reinforcing bar binding machine in which operation is stable even under low temperature environment.

According to one or more embodiments of the invention, a reinforcing bar binding machine is provided with a binding wire feeding mechanism for feeding a binding wire which is wound around a reel to a binding wire guiding nose thereby to form a binding wire loop around a reinforcing bar, and a binding wire twisting mechanism for twisting the binding wire loop which has been formed around the reinforcing bar, by grasping and rotating the binding wire loop, wherein rotation of a driving motor in a normal direction and in a reverse direction is switched by the CPU, whereby one cycle of operation including feeding the binding wire, twisting the binding wire, and returning to the initial position is carried out. The reinforcing bar binding machine is farther provided with a power supply voltage detecting device, a device for comparing the detected voltage with a predetermined CPU operation voltage, and a control device for driving a motor to rotate in the reverse direction, when the voltage has dropped below the predetermined CPU operation voltage, thereby to return the binding wire twisting mechanism to the initial position.

According to one or more embodiments of the invention, detection of the power supply voltage for controlling the return of the binding wire twisting mechanism to the initial position is carried out only during a binding wire twisting step.

In the operation of the reinforcing bar binding machine, it is during the binding wire twisting step that the heaviest load is applied and the drop of the voltage is the largest. Therefore, by detecting and comparing the power supply voltage only during the binding wire twisting step, an object of the invention can be achieved and a control routine is simplified.

In the reinforcing bar binding machine in one or more embodiments of the invention, the power supply voltage during the operation is monitored, and twisting operation is suspended before the voltage drops below the CPU operation voltage, whereby the binding wire twisting mechanism is returned to the initial position. Therefore, it is possible to prevent the binding wire twisting mechanism from being stopped while grasping the binding wire when the CPU stops, and useless troubles such as cutting and unwinding the binding wire which is grasped by the twisting mechanism are not required.

Other aspects and advantages of the invention will be apparent from the following description and the appended claims.

BRIEF DESCRIPTION OF THE DRAWINGS

FIG. 1(*b*) is a side view of the reinforcing bar binding machine in FIG. 1(*a*).

DESCRIPTION OF THE REFERENCE NUMERALS AND SIGNS

Figure 1A:
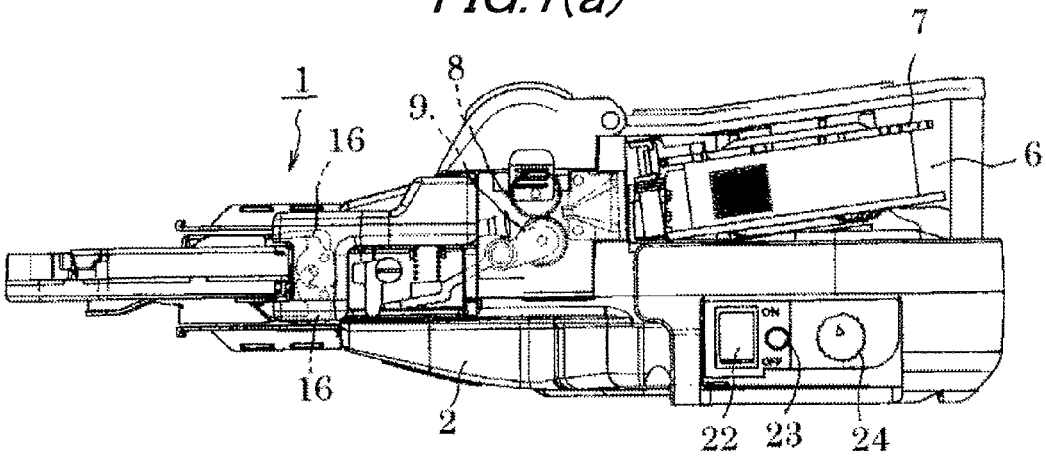
FIG. 1(*a*) is a plan view of a reinforcing bar binding machine in an exemplary embodiment of the invention.

1 Reinforcing bar binding machine
2 Outer casing
3 Grip
4 Trigger Lever
5 Rechargeable battery pack
6 Binding wire wheel room
7 Binding wire reel
8 Main gear
9 Driven gear
10 Guide nose
11 Binding wire twisting mechanism
12 Reduction gear
13 Motor
14 Rotation shaft
15 Sleeve
16 Hook
17 Lever
18 Rotary cutter
19 Link
20 Support shaft
21 Control circuit board
22 Power supply switch
23 Power supply indicator
24 Torque adjusting dial

BEST MODE FOR CARRYING OUT THE INVENTION

Figure 1B:
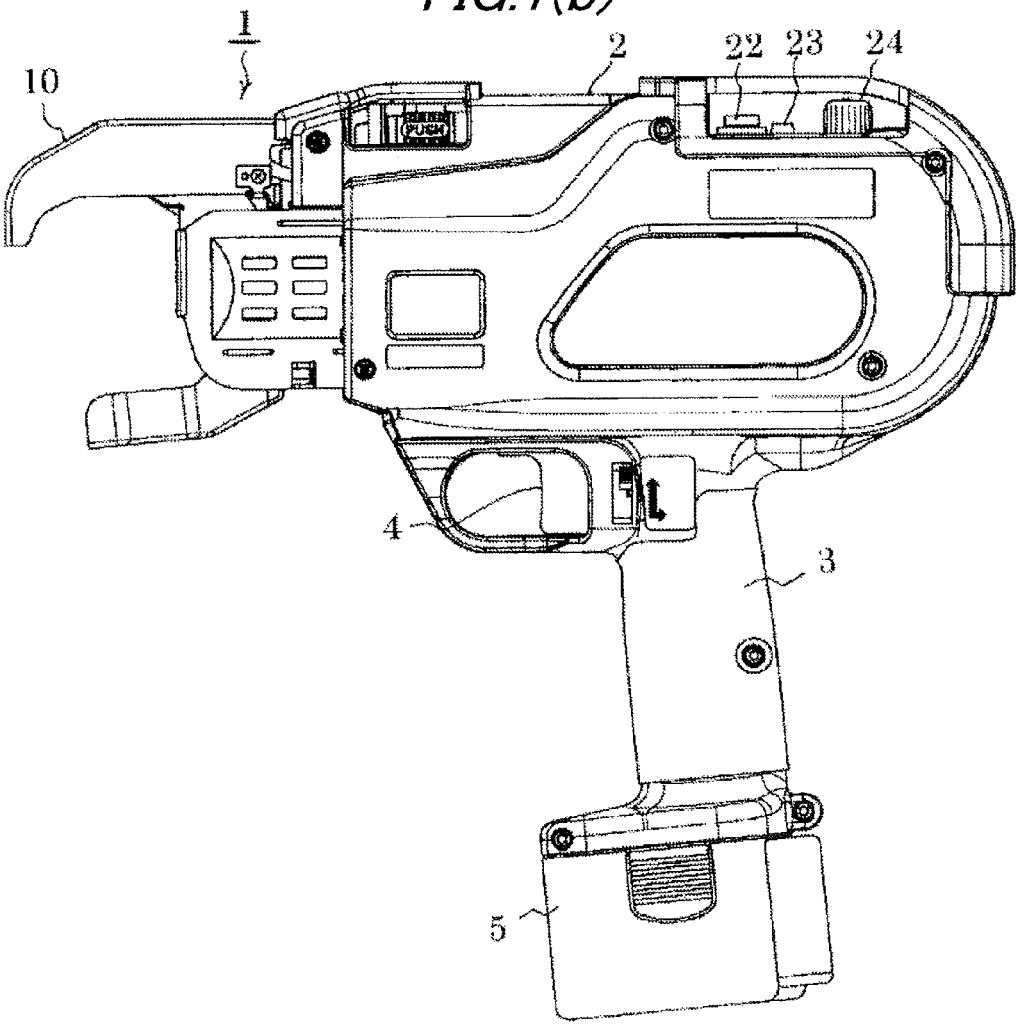

Now, referring to the drawings, an exemplary embodiment of the invention will be described. In FIGS. 1(*a*), 1(*b*), and FIG. 2, a reinforcing bar binding machine 1 is shown. In the reinforcing bar binding machine 1 which has the same mechanical structure as the conventional machine, a grip 3 is extended downward from an outer casing 2, a trigger lever 4 is provided on a front face of a base part of the grip 3, and a rechargeable battery pack 5 is mounted on a lower end of the grip 3.

As shown in FIG. 1(*a*), a binding wire reel containing room 6 is provided on a side face of a rear part of the outer casing 2, and a binding wire of a binding wire reel 7 which is loaded in this room 6 is clamped by a binding wire feeding mechanism including a main gear 8 with a V-shaped groove and a driven gear 9 with a V-shaped groove to be fed forward. Then, the binding wire moves forward while being curved along an inner peripheral face of a curved guide nose 10 which is provided on a front part of the outer casing 2. The binding wire is wound around a reinforcing bar by hanging the guide nose 10 on the reinforcing bar.

Figure 2:
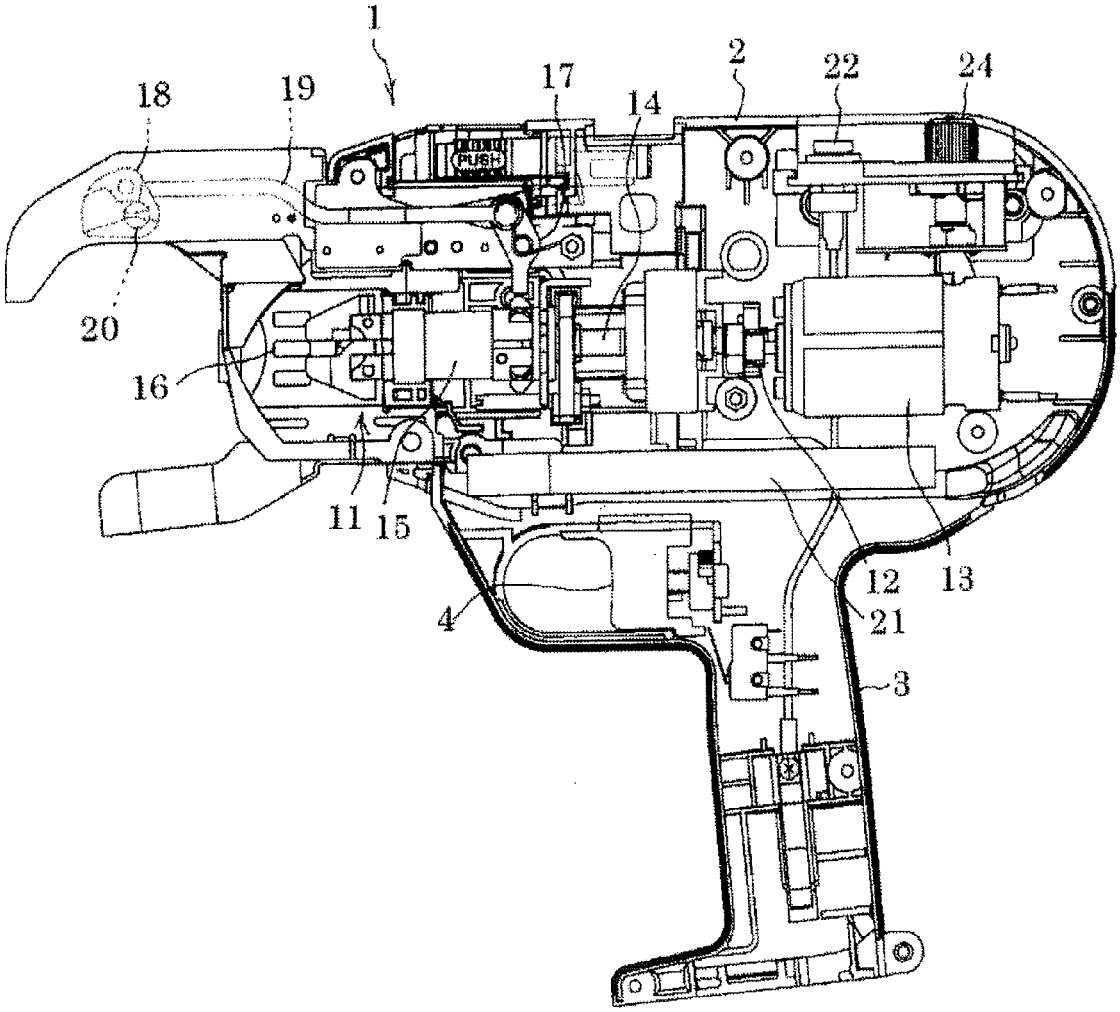
FIG. 2 is a side view showing an interior of the reinforcing bar binding machine.

As shown in FIG. 2, a binding wire twisting mechanism 11 is provided in a longitudinal direction inside the outer casing 2. The binding wire twisting mechanism 11 is driven to rotate by a motor 13 which is connected to a back end thereof by way of a reduction gear 12. A rotation shaft 14 of the binding wire twisting mechanism 11 is threaded, and forms a feed screw mechanism for a sleeve 15 which is fitted over the rotation shaft 14. When the motor 13 rotates in the normal direction, the sleeve 15 moves forward, and a pair of hooks 16 which are provided at a front end of the sleeve 15 are closed by a cam mechanism which is not shown, thereby to grasp the binding wire loop. At the same time, the sleeve 15 pushes a lever 17 of a binding wire cutting mechanism. The lever 17 is coupled to a rotary cutter 18 which is provided in a distal end part of the guide nose 10, by way of a link 19. The rotary cutter 18 is rotatably engaged with a support shaft 20. The binding wire is fed to the guide nose 10 through a groove which is formed on the support shaft 20, and then, cut by the rotary cutter 18 when it rotates in association with the lever 17. The sleeve 15 which has moved forward passes a rotation stopper (not shown) to be disengaged from rotation restraint, and rotates while grasping the binding wire thereby to twist a binding wire loop, whereby the reinforcing bar is tightened.

While twisting of the binding wire proceeds, a twisting load is increased, and electric current which is flowing into the motor 13 is also increased. When the electric current has reached a preset value, a control part rotates the motor 13 in the reverse direction. With the reverse rotation of the motor, the sleeve 15 of the binding wire twisting mechanism 11 moves backward, and the hooks 16 at the front end thereof are opened to release the binding wire. Then, the sleeve 15 returns to an initial position to stop there. The above described is one cycle of the reinforcing bar binding operation. By once pulling the trigger lever 4, one cycle of the operation (i.e., a reinforcing bar binding step) is instantaneously carried out.

As shown in FIG. 2, a control circuit board 21 is provided below the binding wire twisting mechanism 11, and as shown in FIG. 1(*a*), a power switch 22, a power supply indicator 23, and a torque adjusting dial 24 are provided on an upper face of the outer casing 2 in the back part thereof. The torque adjusting dial 24 sets the electric current for controlling the above described reverse rotation of the motor, and can adjust torque at a time of binding (strength of twist), according to a level of the preset value of the electric current. In case where twisting torque is weak, the reinforcing bar is unable to be tightened, and binding strength becomes insufficient. On the other hand, in case where the twisting torque is too strong, the binding wire will be broken by twisting. Therefore, it is necessary to appropriately adjust the torque according to thickness, the number of windings, etc. of the binding wire.

A CPU (not shown) which is mounted on the control circuit board 21 monitors electric voltage of the rechargeable battery by means of a voltage detecting circuit at every predetermined time. When the electric voltage has dropped to a predetermined voltage value recommended to be recharged, the CPU announces a drop of the voltage by sounding a buzzer.

Although the reinforcing bar binding machine 1 according to the invention has the same mechanical structure as the conventional machine, the invention is characterized in that a control device for preventing stop of the operation of the CPU due to a temporary drop of the electric voltage during the binding operation. Specifically, apart from ordinary monitoring of the electric voltage, the control device monitors the power supply voltage during the twisting operation so that a drop of the voltage below the CPU operation voltage may be avoided, whereby the stop of the operation during the twisting step can be prevented.

Figure 3:
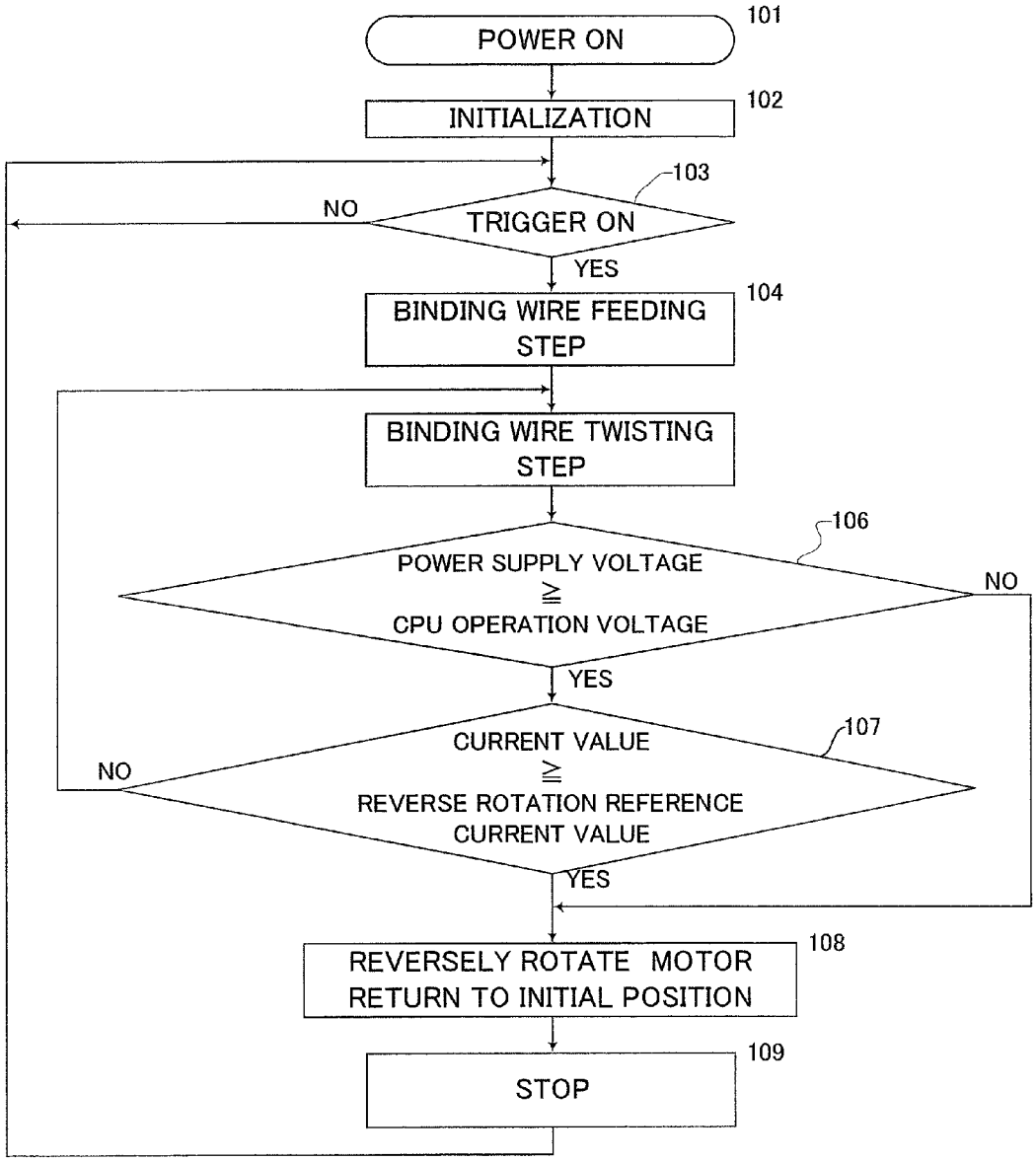
FIG. 3 is a flow chart of operation of the reinforcing bar binding machine.

Now, referring to FIG. 3, operation of the reinforcing bar binding machine 1 will be described. When the power supply is turned on (step 101), the operation proceeds to step 102, in which the machine conducts initialization (a series of motions which includes feeding a predetermined amount of the binding wire, cutting a distal end thereof, aligning the distal end of the binding wire at a position of the rotary cutter 18, and returning the twisting mechanism to a standby position (the initial position)), and rests in a standby state.

As described above, the CPU monitors the voltage of the rechargeable battery by means of the voltage detecting circuit at every predetermined time, apart from this flow chart, and in case where the voltage is lower than a lower limit value of the operation, the CPU announces a drop of the voltage by sounding a buzzer.

In case where the voltage is higher than the lower limit value of the operation, by once pulling the trigger lever (step 103), the binding wire feeding mechanism is driven to feed the binding wire (step 104), and then, a binding wire twisting step (step 105) which includes grasping the binding wire by the binding wire twisting mechanism, cutting it by the cutting mechanism, and twisting it by the binding wire twisting mechanism is conducted.

In step 105, the CPU monitors the power supply voltage during the binding wire twisting step, apart from the ordinary monitoring of the voltage as described above, and compares the power supply voltage with a predetermined CPU operation voltage (step 106). As the twisting of the binding wire proceeds, the load is increased and the electric current is also increased to show a drop of the power supply voltage. At a moment when the power supply voltage drops to the lower limit of the predetermined CPU operation voltage, the machine proceeds to step 108, in which the motor 13 is rotated in the reverse direction to enter into a returning motion from the twisting motion, whereby the twisting mechanism is returned to the initial position and stops there (step 109).

Although the voltage of the battery is lower than the lower limit value of the operation when the binding operation starts, it sometimes occurs that the voltage may remarkably drops during the twisting operation due to deterioration of discharging performance of the battery, in case where discharge of the battery proceeds, or under very cold environment. However, according to the invention, the twisting operation is suspended before the voltage drops below the CPU operation voltage, and the binding wire twisting mechanism is returned to the initial position. Therefore, in case where the power supply voltage has dropped below the predetermined CPU operation voltage during the twisting operation, even though the binding strength which has been preset cannot be obtained, such phenomenon that the binding wire twisting mechanism stops while grasping the binding wires can be avoided. Therefore, such useless troubles as cutting or unwinding the binding wire which is grasped by the binding wire twisting mechanism are not required.

When the discharging performance of the battery is sufficient, and the drop of the voltage is small in such a case that the outside temperature is not extremely low, the machine proceeds from comparison of the voltages (step 106) to step 107 in which the twisting operation is continued until the actual current value reaches a reference current value for the reverse rotation which has been set by the torque adjusting dial. When the current value is increased up to the preset value, the ordinary motion of reversely rotating the motor is conducted (step 108), whereby the twisting mechanism is returned to the initial position to stop there (step 109).

It is apparent that this invention is not limited to the above described embodiment, but various modifications can be made within a technical scope of the invention, and the modified embodiments also belong to the invention.

This application is based on Japanese Patent Application (Application No. 2005-194206) filed on Jul. 1, 2005, the contents of which are hereby incorporated by reference.

INDUSTRIAL APPLICABILITY

This invention can be applied to a reinforcing bar binding machine, and more particularly, to the reinforcing bar binding machine in which improvement in stability of performance under low temperatures or at a drop of electric voltage is achieved.

The invention claimed is:

1. A reinforcing bar binding machine comprising:

a binding wire feeding mechanism that feeds a binding wire which is wound around a reel to a binding wire guiding nose and forms a binding wire loop around a reinforcing bar;

a binding wire twisting mechanism that twists the binding wire loop formed around the reinforcing bar, by grasping and rotating the binding wire loop;

a power supply voltage detecting device;

a device for comparing a detected voltage of the power supply with a predetermined minimum operation voltage required to operate the reinforcing bar binding machine; and a control device that drives a motor in a reverse direction, when the detected voltage of the power supply has dropped below the predetermined operation voltage, thereby to return the binding wire twisting mechanism to an initial position, wherein the detection of the power supply voltage for controlling the return of the binding wire twisting mechanism to the initial position is carried out only during a reinforcing bar binding step.

2. The reinforcing bar binding machine according to claim 1, further comprising a CPU, wherein rotation of the motor in a normal direction and in the reverse direction is switched by the CPU signaling control device, whereby one cycle of operation including feeding the binding wire, twisting the binding wire, and returning the binding wire twisting mechanism to the initial position is carried out.

3. A reinforcing bar binding machine comprising:

a binding wire feeding mechanism including a sleeve and adapted to feed a binding wire which is wound around a reel to a binding wire guiding nose and forms a binding wire loop around a reinforcing bar;

a binding wire twisting mechanism adapted to twist the binding wire loop formed around the reinforcing bar by driving a motor in a normal direction;

a power supply voltage detecting device;

a device for comparing a detected voltage with a predetermined voltage; and a control part, wherein the control part is adapted, during a binding wire twisting operation by the binding wire twisting mechanism, if the detected voltage is higher than the predetermined voltage, to rotate the motor in a reverse direction so as to return the sleeve to an initial position, after the twisting operation proceeds, when an electric current flowing through the motor reaches a preset current value, and to rotate the motor in the reverse direction so as to return the sleeve to the initial position, at a moment when the detected voltage drops to the predetermined voltage, and wherein the power supply voltage detecting is adapted to detect a voltage of a power supply only during a reinforcing bar binding step.

* * * * *